US008708287B2

(12) United States Patent
Ackeret et al.

(10) Patent No.: US 8,708,287 B2
(45) Date of Patent: Apr. 29, 2014

(54) PAWL LOCK WITH CLOSURE CLAMP SCREW

(75) Inventors: Walter Ackeret, Seuzach (CH); Rudolf Herrmann, Winterthur (CH); Andreas Infanger, Rafz (CH)

(73) Assignee: Siemens Schweiz AG, Zurich (CH)

( * ) Notice: Subject to any disclaimer, the term of this patent is extended or adjusted under 35 U.S.C. 154(b) by 143 days.

(21) Appl. No.: 13/352,398

(22) Filed: Jan. 18, 2012

(65) Prior Publication Data

US 2012/0181394 A1 Jul. 19, 2012

(30) Foreign Application Priority Data

Jan. 19, 2011 (EP) ..... 11151348

(51) Int. Cl.
*E01B 7/02* (2006.01)
*E01B 9/00* (2006.01)

(52) U.S. Cl.
USPC ..... 246/448; 238/315

(58) Field of Classification Search
USPC ..... 246/415 R, 435 R, 442, 452, 453; 238/310, 315–317, 372–374
See application file for complete search history.

(56) References Cited

U.S. PATENT DOCUMENTS 2,250,891 A * 7/1941 Martin ..... 238/292
2,904,256 A * 9/1959 Devaney, Jr. ..... 238/292
7,389,940 B2 * 6/2008 Kurzo ..... 238/310

FOREIGN PATENT DOCUMENTS

EP 0 624 508 A1 11/1994

* cited by examiner

*Primary Examiner* — Robert McCarry Jr.
(74) *Attorney, Agent, or Firm* — Laurence A. Greenberg; Werner H. Stemer; Ralph E. Locher

(57) ABSTRACT

A lock bearing for a points setting arrangement has a lock bearing screw penetrating a foot of a setting tongue and an anti-rotation ring enclosing the head of the lock bearing screw in an annular, force-fitted manner with an outer toothing and a safety plate matching the outer toothing. It therefore is possible to tighten the lock bearing screw within a small torque range and only to have to align the lock bearing screw with the pitch of the outer toothing. Therefore if, for example, the outer toothing has 36 teeth, the lock bearing screw only need to be aligned within a range of maximum 10°. The anti-rotation ring functions like an adapter for the toothing mass and contributes to the fact that no modifications need to be carried out on the remaining construction of the lock bearing, which is advantageous as regards safety and approval considerations.

2 Claims, 3 Drawing Sheets

FIG. 4A
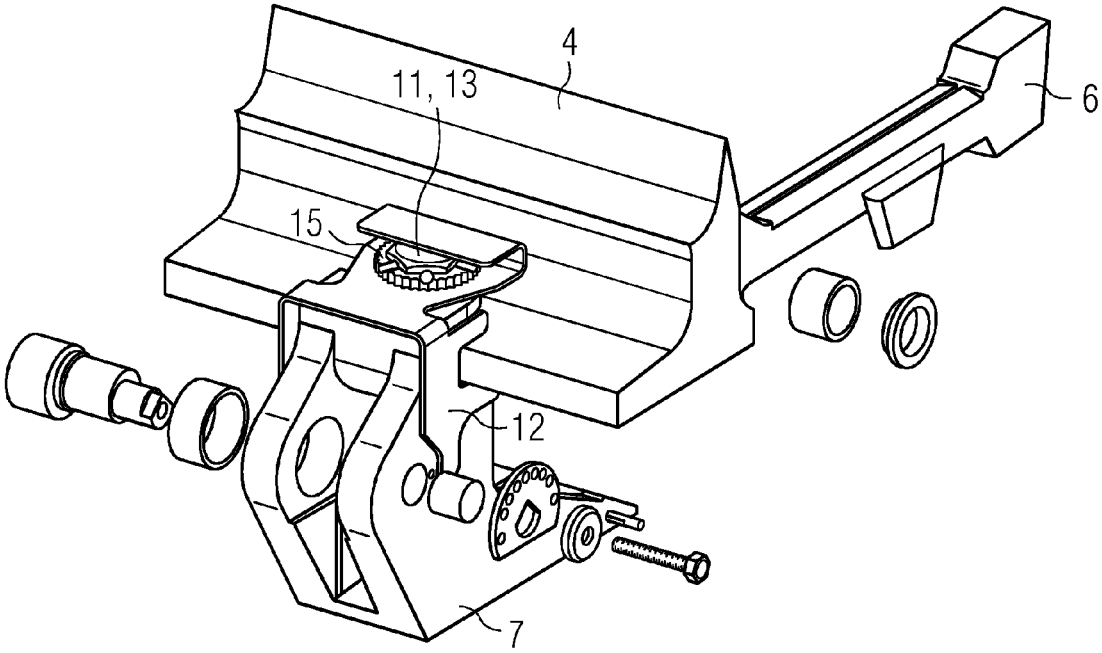
FIG. 4B
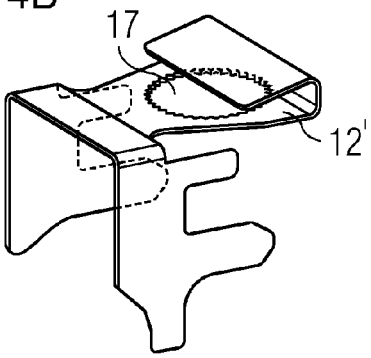
FIG. 4C
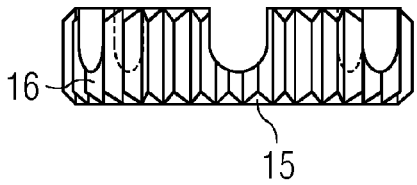
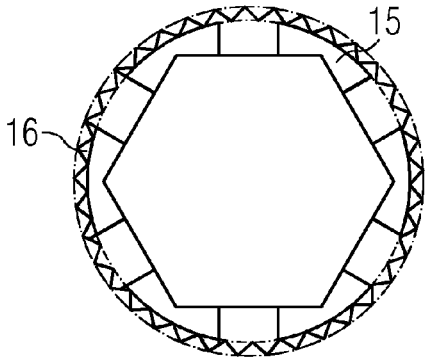
FIG. 4D

PAWL LOCK WITH CLOSURE CLAMP SCREW

CROSS-REFERENCE TO RELATED APPLICATION

This application claims the priority, under 35 U.S.C. §119, of European application EP 11151348, filed Jan. 19, 2011; the prior application is herewith incorporated by reference in its entirety.

BACKGROUND OF THE INVENTION

Field of the Invention

The present invention relates to a pawl lock with a closure clamp screw.

For the setting of railway points pawl locks inter alia are also used. The construction of a pawl lock is described in great detail in European patent application EP 0 624 508 A1. The pawl lock for the setting tongues of railroad points described therein contains a lock latch which can be actuated by a slide rod and a locking piece, wherein the lock latch is arranged pivotably in a lock bearing and the setting tongue is fixed at the upper end of the lock bearing.

Lock bearings of this kind are employed in railroad points, in order to draw the tips of the setting tongues to the neighboring rail flank and fix them thereto. The setting tongues are here guided in a sliding manner on the rail sleeper over a certain length. The one end here passes into parts of the rail fixedly connected with the sleepers, while the tongue tip can be shifted by a device. In the closed position the tongue tip is here drawn to the neighboring rail flank and held or clamped there, while in the opened position it is located at a certain distance from the rail flank. In the case of the pawl lock disclosed there, the lock bearing abuts the locking piece in a form-fitted manner with the lock latch closed. This serves to prevent the lock bearing from being able to twist. This also prevents the twisting resulting in the setting tongue twisting and being lifted from the rail flank or a gap arising between the rail flank and the tongue tip. FIG. 1 shows a view of the pawl lock in the closed position. A locking piece 2 is attached to a rail 1 on one side of a foot of the rail by holding clamps 3, which hook in place under the rail on the other side of the rail foot. A setting tongue 4 of the switch is connected at its free end with a lock bearing 5. The setting tongue 4 is here represented in the abutting position, that is to say the setting tongue 4 is pressed against the rail flank. A lock latch 6 is arranged pivotably on the lock bearing 5 in a bearing 7. A slide rod 8 is provided for adjustment of the setting tongue 4. The slide rod 8 is moved transversely to the longitudinal axis of the rail by a non-illustrated drive. The lock latch 6 and the slide rod 8 are now embodied in such a way that the free end of the lock latch 6 can slide under the foot of the rail 1 as shown in FIG. 1. The pawl lock now ensures that in the closed position the setting tongue 4 is connected to the rail 1 in a form-fitted manner via the lock latch 6. The setting of this connection can for example be achieved in that the bearing 7 has a setting possibility by use of an eccentric. The orientation of the lock latch 6 can thus be set or subsequently adjusted in such a way that an abutment surface 9 abuts the locking piece 2 with a defined degree of play, when the setting tongue 4 abuts the flank of the rail 1.

In the case of such locks the problem can arise that the setting tongue 4 can twist axially. The twisting leads to a lifting or gaping of the upper area of the setting tongue 4 from the flank of the rail 1. A lifting or gaping of the setting tongue by just a few millimeters can result in unwelcome consequences, in that the wheels of a train can thereby impact at this point. In order to solve this problem, a web 9 can be provided at the foot of the lock bearing 5, which with the lock in the closed position strikes the foot of the locking piece 2, as shown in FIG. 1. As a result of this measure a twisting and thus a lifting of the setting tongue 4 from the flank of the rail 1 is effectively prevented in a simple manner.

For assembly of such a pawl lock in a switch, the lock bearing 5 must inter alia be mounted on the foot of the setting tongue 4. To this end the setting tongue 4 has a drilled hole, into which a closure clamp screw 11 is screwed. Here the closure clamp screw 11 according to the prior art is tightened with a maximum torque and subsequently secured with a safety plate 12. The safety plate is here embodied as a spring plate and has a hole, which corresponds to the screw head. It is here initially pressed in the direction of the arrow over the hexagonal head and latches in place over the screw head, when the screw head matches the hole in the safety plate 12. The hexagonal head of the closure clamp screw 11 must be aligned with the safety plate 12, so that on tightening of the closure clamp screw a further retightening of up to 60° can be called for, which as regards the thread strengths of for example M20 (and the associated thread pitch) once again requires very great forces, which may possibly have an unfavorable effect on the connected components.

SUMMARY OF THE INVENTION

It is accordingly an object of the invention to provide a pawl lock with a closure clamp screw which overcomes the above-mentioned disadvantages of the prior art devices of this general type, which specifies a solution attachment of the lock bearing to the foot of a setting tongue, and is characterized by a simplified assembly that places less strain on the components.

A first inventive solution for the problem provides a lock bearing for a points setting arrangement with a lock bearing screw penetrating a foot of a setting tongue and a spring package arranged between the foot and the screw head of the lock bearing screw. In this way, the lock bearing screw can be tightened with a relatively narrowly definable torque range and at the same time still has the rotation reserve to bring the position of the head of the lock bearing screw into line with a hole in a safety plate which maps the screw head mapping, which then upon insertion as previously known latches in place over the head of the lock bearing screw.

A second inventive solution for this problem provides a lock bearing for a points setting arrangement with a lock bearing screw penetrating a foot of a setting tongue and an anti-rotation ring with an outer toothing enclosing the head of the lock bearing screw in an annular force-fitted manner, and a safety plate matching the outer toothing. It is here likewise also possible to tighten the lock bearing screw within a relatively small torque range and here only to have to align the lock bearing screw in the pitch of the outer toothing. If therefore for example the outer toothing has 36 teeth, the lock bearing screw only needs to be aligned within a maximum range of 10°. The anti-rotation ring here functions like an adapter for the toothing mass and contributes to the fact that no modifications need to be performed on the remaining construction of the lock bearing and the lock bearing screw, which is also absolutely advantageous as regards safety and approval considerations.

Other features which are considered as characteristic for the invention are set forth in the appended claims.

Although the invention is illustrated and described herein as embodied in a pawl lock with a closure clamp screw, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 4A is a diagrammatic, perspective view of the lock bearing with an anti-rotation adapter mounted on a closure clamp screw according to the invention;

FIG. 4B is a diagrammatic, perspective view of the anti-rotation adapter according to the invention;

FIG. 4C is a diagrammatic, side view of a locking device adapter according to the invention; and FIG. 4D is a plan view of the locking device adapter according to the invention.

DETAILED DESCRIPTION OF THE INVENTION

Figure 1:
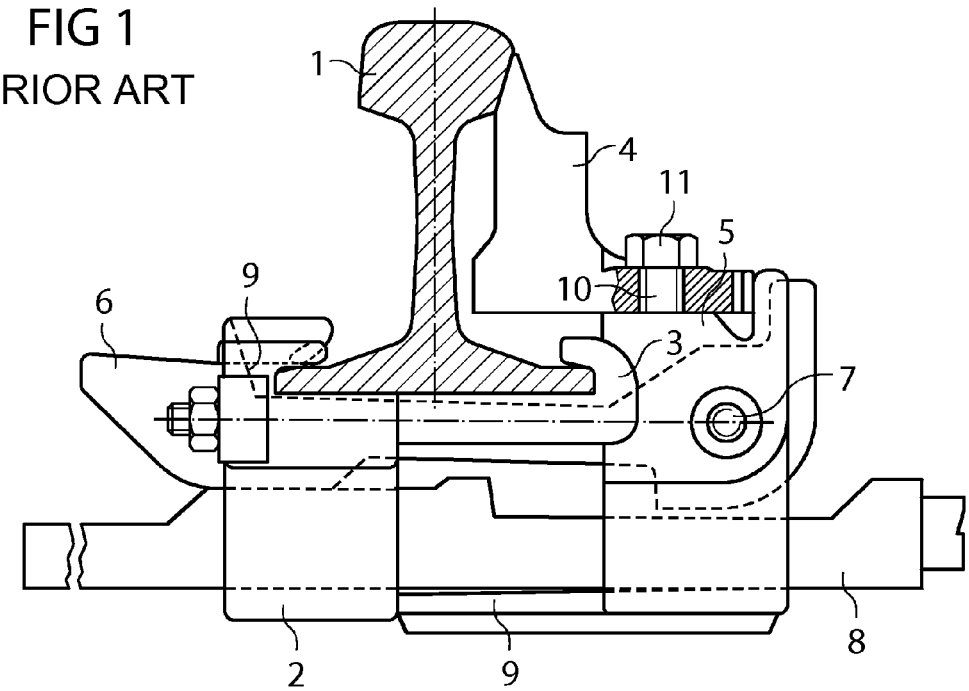
FIG 1 PRIOR ART
FIG. 1 is a diagrammatic, side view of a pawl lock in use with a locking piece braced on a rigid rail and a lock bearing fixed on a setting tongue according to the prior art.
Figure 2:
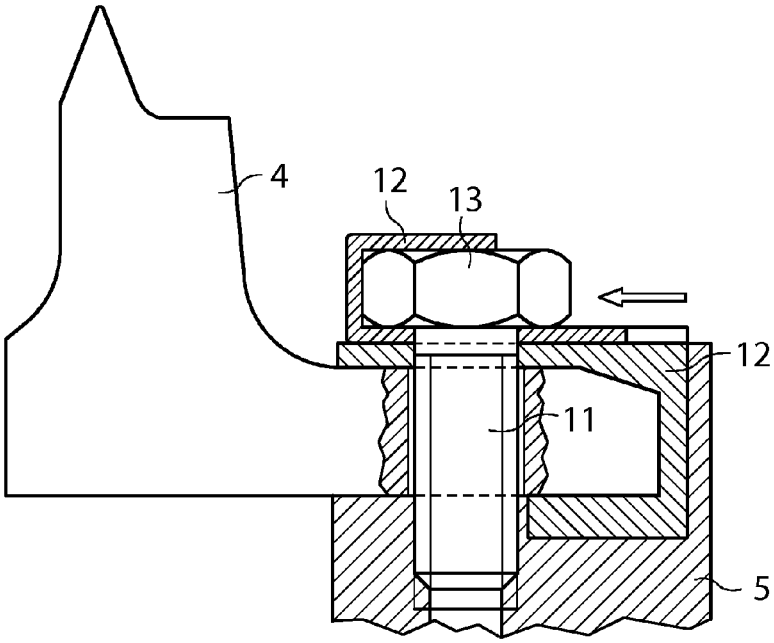
FIG 2 PRIOR ART
FIG. 2 is an enlarged view of the setting tongue with the lock bearing fixed thereupon according to the prior art.

Referring now to the figures of the drawing in detail and first, particularly, to FIG. 2 thereof, there is shown a schematic view of a setting tongue 4 with the lock bearing 5 fixed thereupon, in a representation which is enlarged compared with FIG. 1. A head 13 of the lock bearing screw 11 fixes the lock bearing 5 with a perpendicular pressure on the setting tongue 4. The head 13 is a hexagonal head. The safety plate 12, which is embodied as a spring plate has a hole, which corresponds to the hexagonal head in terms of area. If the safety plate 12 is now pushed over the head 13, it bends upwards and latches in place over the head 13 at the moment when the hole and the head 13 match completely. Accordingly, the head 13 must be precisely aligned with the hole in the safety plate 12.

Figure 3A:
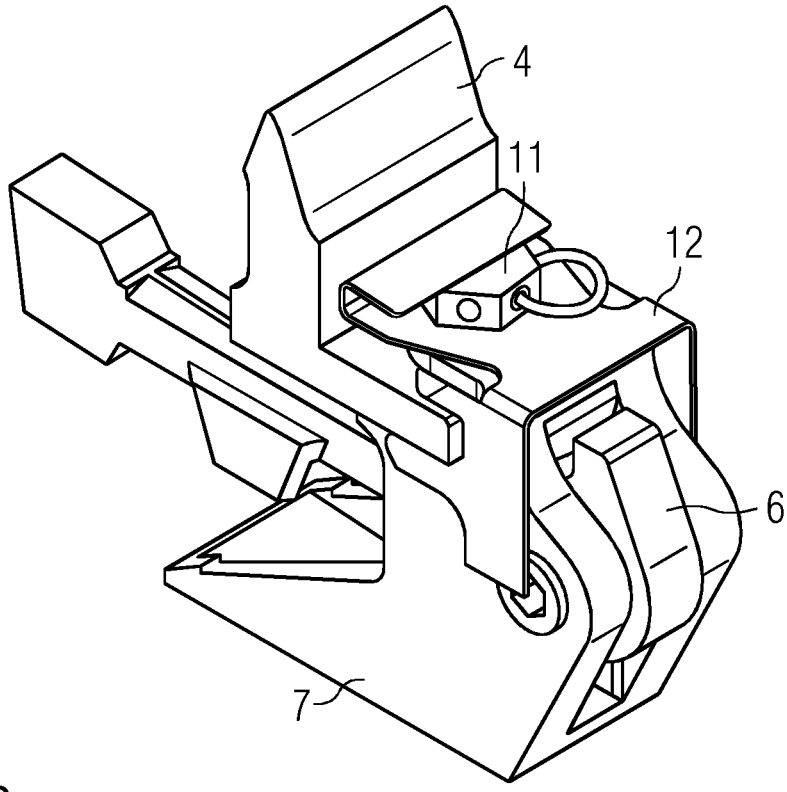
FIG. 3A is a diagrammatic, perspective view of a lock bearing with an introduced spring package according to the invention.
Figure 3B:
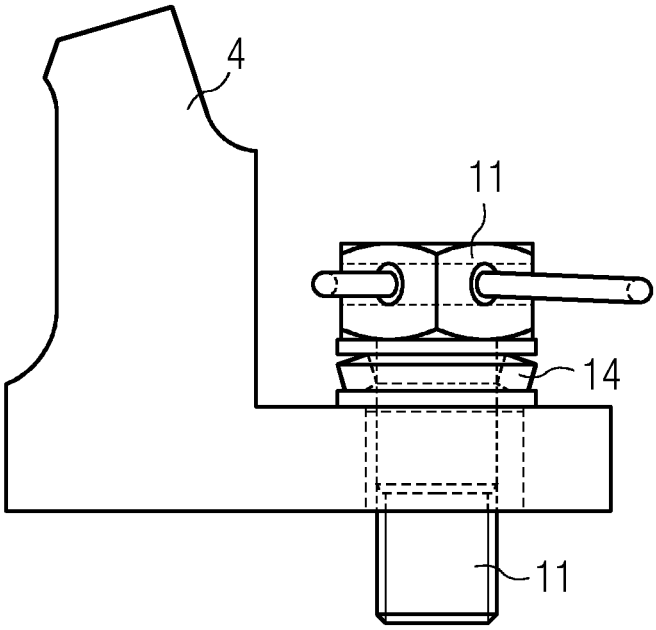
FIG. 3B is an enlarged view of the lock bearing with the introduced spring package according to the invention.

FIG. 3A shows the situation according to FIG. 2 with an inventive spring package 14 inserted under the head 13 of the lock bearing screw 11 (for a detailed view see FIG. 3B). The lock bearing screw 11 can thereby be fixed within a small torque range. At the same time this solution permits a further slight tightening of the lock bearing screw 11, in order to bring the position of the screw head 13 into line with the hole in the safety plate 12. Here the spring reserve present in the spring package 14 ensures that the screwing process does not cause any impermissible tensions in the screwed components.

FIG. 4A shows the situation according to FIG. 2 with an inventive locking device adapter 15 mounted on the head 13 of the lock bearing screw 11. The locking device adapter 15 is embodied in annular form (see FIGS. 4C and 4D) and has on its inner periphery a shape largely form-fitted, but in any case force-fitted exactly to the shape of the hexagonal head 13 of the lock bearing screw 11 (see FIG. 4D). On its outer periphery the locking device adapter 15 has an outer toothing 16, which is significantly finer than the hexagon of the head 13. A hole 17 in the safety plate 12' precisely maps the course of the outer toothing 16, so that the safety plate 12' latches in place over the locking device adapter 15, when the outer toothing 16 and the hole 17 match. The lock bearing screw 11 or its head 13 thus need not be aligned at all during the tightening. Smaller corrections of the screw position are possible by a pin which can be introduced into the screw head 13, which permits the fine adjustment of the lock bearing screw 11 relative to the outline of the hole 17 in the safety plate 12'.

The invention claimed is:

1. A lock bearing for a points setting configuration, the lock bearing comprising:

a lock bearing screw penetrating a foot of a setting tongue and having a head;

a locking device adapter annularly enclosing said head of said lock bearing screw and having an outer toothing; and a safety plate having a hole formed therein, said hole defining an inner toothing matched for receiving said outer toothing of said locking device adapter.

2. The lock bearing according to claim 1, wherein said locking device adapter has an annular profile that mates with said head of said lock bearing screw to have said locking device rotate together with said lock bearing screw.

* * * * *